United States Patent [19]

Scott

[11] 3,954,088

[45] May 4, 1976

[54] COMBUSTION CHAMBER ARRANGEMENTS FOR ROTARY COMPRESSION-IGNITION ENGINES

[75] Inventor: William Murray Scott, Brighton, England

[73] Assignee: Rolls-Royce Motors Limited, Cheshire, England

[22] Filed: Oct. 1, 1974

[21] Appl. No.: 511,479

[30] Foreign Application Priority Data

Oct. 9, 1973 United Kingdom ..... 47176/73

[52] U.S. Cl. ..... 123/8.11; 123/32 SP; 123/191 S

[51] Int. Cl.[2] ..... F02B 53/04; F02B 19/14; F02B 23/02

[58] Field of Search ..... 123/8.09, 8.13, 8.11, 123/32 SP, 32 ST, 191 S, 191 SP

[56] References Cited

UNITED STATES PATENTS

| | | | |
|---|---|---|---|
| 2,120,768 | 6/1938 | Ricardo | 123/32 SP |
| 3,140,697 | 7/1964 | Peras | 123/32 SP |
| 3,283,750 | 11/1966 | Lohner | 123/8.11 |
| 3,857,369 | 12/1974 | Sabet | 123/8.13 |

FOREIGN PATENTS OR APPLICATIONS

| | | | |
|---|---|---|---|
| 1,451,703 | 2/1969 | Germany | 123/8.09 |
| 947,284 | 1/1964 | United Kingdom | 123/8.09 |
| 777,970 | 7/1957 | United Kingdom | |
| 18,616 | 1/1956 | Germany | 123/32 SP |

*Primary Examiner*—C. J. Husar
*Assistant Examiner*—Leonard Smith
*Attorney, Agent, or Firm*—Cushman, Darby & Cushman

[57] ABSTRACT

A rotary piston compression-ignition internal combustion engine comprises a primary ignition chamber communicating with the main rotor chamber via a tubular insert of highly refractory material fixed in a bore formed in the rotor housing. The tube is screwed in the bore and shoulders on the insert and bore provide a positive location. The insert stops short of the end of the bore leading obliquely into the main rotor chamber and a fuel injector is disposed with its injection axis projecting obliquely and near-tangentially into that part of the primary ignition chamber remote from the main chamber.

16 Claims, 4 Drawing Figures

Figure 1A:
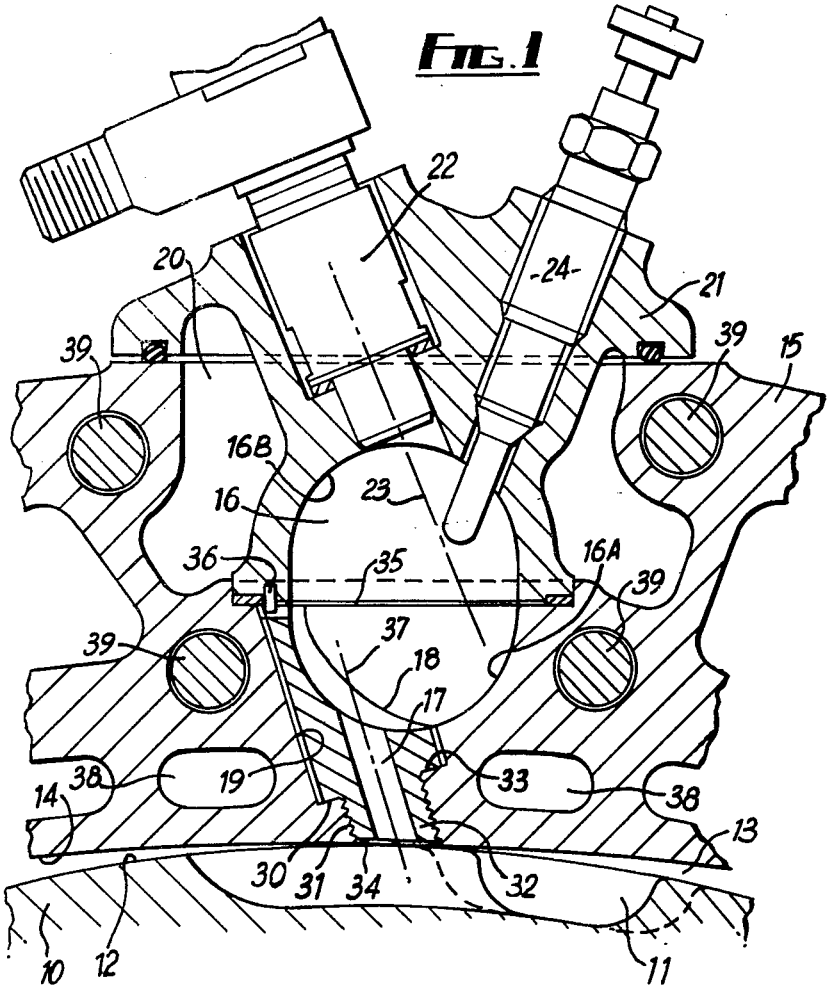

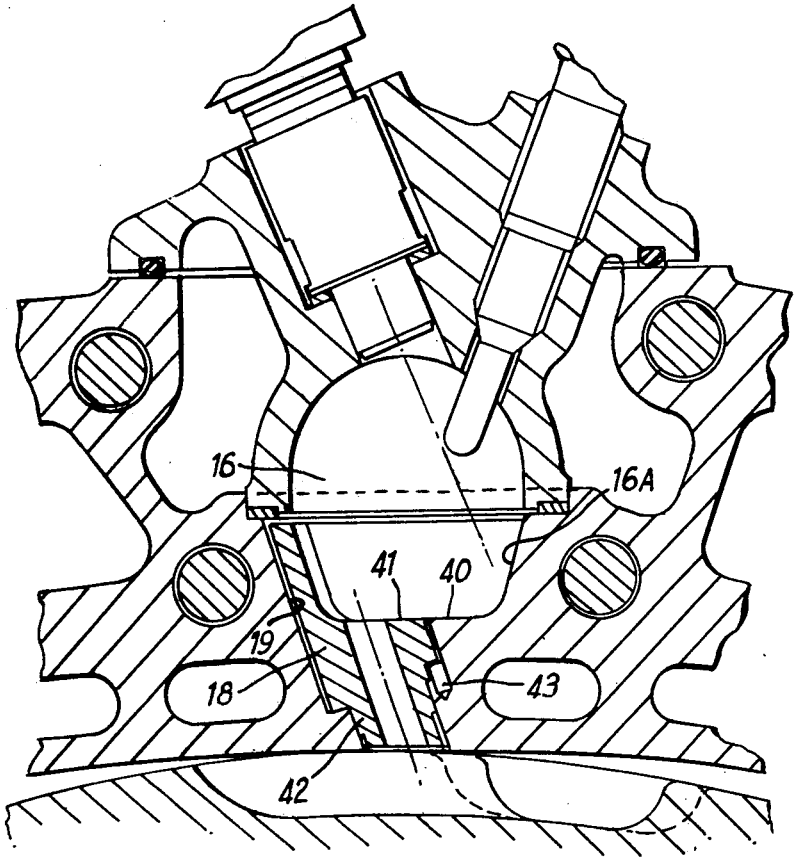
FIG. 2
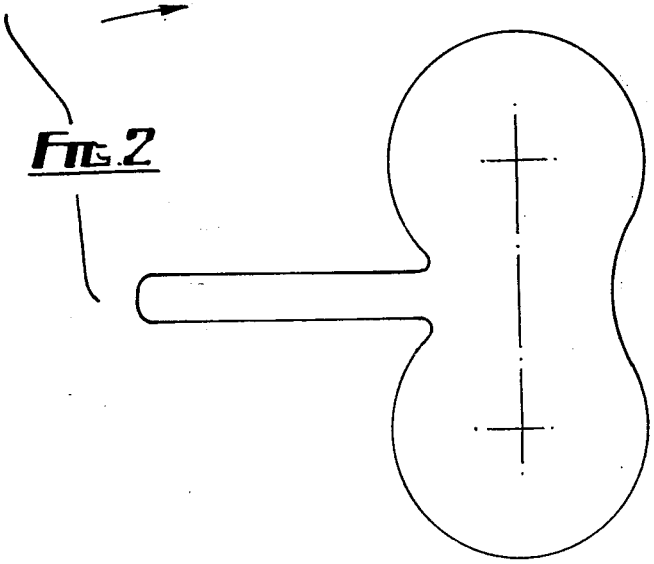

COMBUSTION CHAMBER ARRANGEMENTS FOR ROTARY COMPRESSION-IGNITION ENGINES

This invention relates to rotary internal combustion engines of the compression-ignition type using an injected liquid fuel, and particularly although not exclusively to rotary Diesel engines.

A known form of primary ignition chamber used in piston-type Diesel engines is described in British Patent specification No. 777,970, the chamber being formed in the cylinder head and being of generally rounded form with a flat "bottom" surface, formed by a so-called "hot-plug" of refractory material which is inserted into a recess in the cylinder head. The transfer passage is formed in the "hot-plug".

The use of a primary ignition chamber of this design in a rotary engine would present several problems however. Firstly, the rotor tip seals would have to run over the hole in the rotor housing where the externally-inserted "hot-plug" affording the transfer passage breaks through into the combustion chamber surface. This means that the hot-plug would have to be recessed below that surface by a sufficient amount to avoid its projection into the path of the seals in conditions of greatest thermal expansion.

Secondly, the aperture in the rotor housing to accommodate the externally-inserted primary chamber member would be large, and would be a source of weakness in the housing structure. The breakthrough into the chamber surface would also be large, providing a source of leakage across the rotor tip seals unless it was located at a neutral pressure point.

Thirdly, the size of the hot-plug in the region of the transfer passage or throat would normally involve the elimination of a through-bolt, with consequent gasket problems.

According to the present invention, there is provided a rotary piston compression-ignition internal combustion engine comprising a housing defining a main chamber comprising $n$ lobes, and a subsidiary chamber which serves as a primary ignition chamber and which communicates with the main chamber, a shaft extending axially of the housing, an $(n+1)$ sided piston eccentrically mounted on the shaft and rotatable in the housing, a seal mounted at each apex formed between each pair of adjacent sides of the piston and means for injecting fuel into the primary ignition chamber.

The primary ignition chamber acts as a swirl chamber, a proportion of the air aspirated and partially compressed in the main combustion space being forced through the transfer passage into the primary ignition chamber during the compression stroke and setting up a swirl in the chamber, thereby improving the combustion and reducing undesirable exhaust emissions.

Advantageously, the primary ignition chamber communicates with the main chamber via a tubular insert in a bore in the rotor housing.

This insert tube takes the place of the known "hot-plug" by virtue of its thermal capacity, and the whole of the primary ignition chamber, top and bottom, is cooled, for example by liquid coolant passages in the housing wall. The chamber will experience thermal loading similar to that on a two-stroke engine, but probably more severe because the chamber never experiences scavenge air.

In the preceding description the references to the "bottom" wall of the primary chamber and to the "lower" part of the chamber, and to the "lower" ends of the insert tube and of the bore in the housing, all refer to the wall, part and ends nearest to the rotor and to the chamber in the housing in which the rotor is mounted, regardless of any specific orientation of the engine as a whole.

Figure 1A:
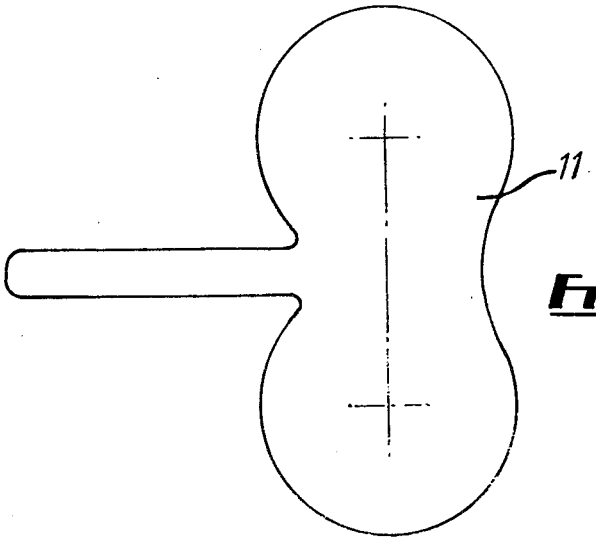
Figure 3:
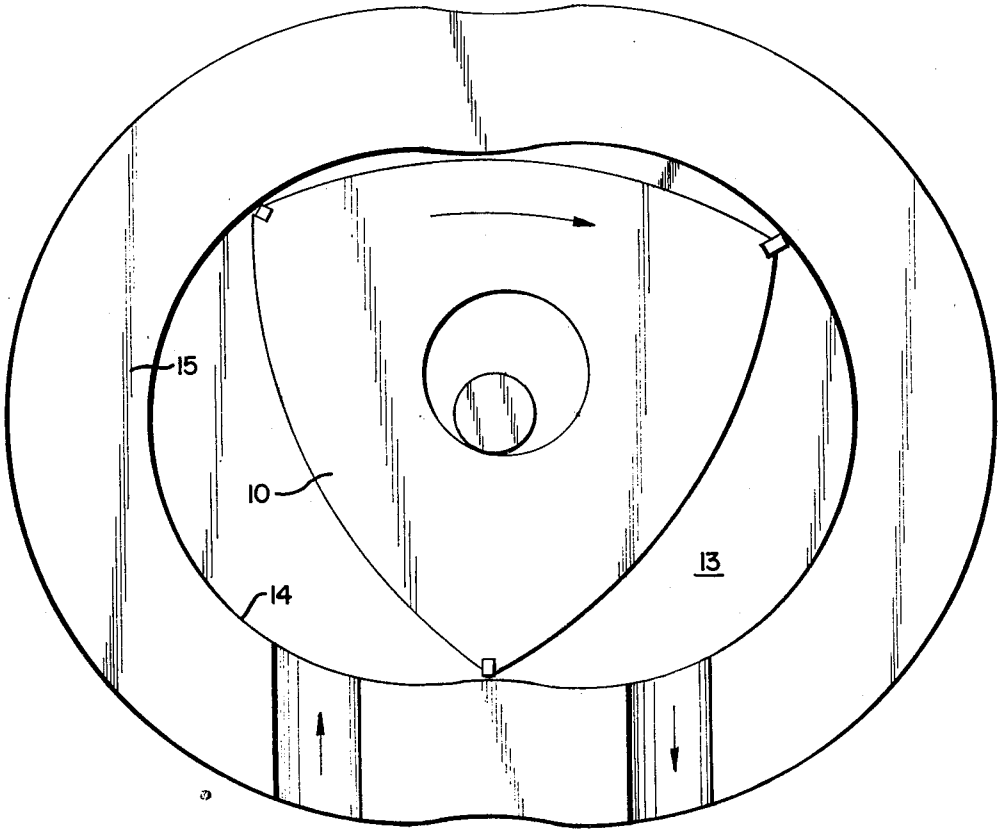

The invention may be carried into practice in various ways, but two specific embodiments will now be described by way of example only and with reference to the accompanying drawings, in which:

FIG. 1 is a sectional view of a part of the housing wall of a rotary piston Diesel engine and of an adjacent part of its rotor, the section plane being perpendicular to the rotor axis, FIG. 1A is a plan of the rotor combustion recess, FIG. 2 is a similar view of a modified embodiment of the invention, and FIG. 3 is an illustration of the rotor and apex seals.

Referring to FIG. 1, a rotary piston Diesel engine having a rotor 10 is shown with a combustion recess 11, shown in plan in FIG. 1A, formed in each flank 12 of the rotor. The rotor precesses eccentrically in a two lobed chamber 13 having an internal surface 14 of epitrochoidal form, the chamber 13 being formed in the water-cooled housing 15.

A primary ignition chamber 16 is formed in the wall of the housing 15 and communicates with the rotor chamber 13 through a transfer passage or throat constituted by the bore 17 of an insert tube 18 fitted into a bore 19 formed in the inner part of the thickness of the housing wall. The lower part 16A of the chamber 16 is of almost-hemispherical shape and is formed as a machined recess in the wall of the housing 15 at the bottom of a larger, water-cooled recess 20. The upper part 16B of the chamber 16 is also of nearly-hemispherical form and is formed as a machined recess in a water-cooled plug 21 which is inserted into the recess 20 from outside the housing 15. A fuel injector 22 mounted in a recess in the plug 21 with its injection axis 23 projecting obliquely and near-tangentially into the upper part 16B of the primary ignition chamber 16. A starter plug 24 is also provided in the plug 21.

The bore 19 formed in the wall of the housing 15 breaks obliquely at its inner end into the trochoidal surface 14 of the rotor chamber, and at its upper end enters the lower part 16A of the chamber 16. The bore 19 is formed with an upwardly-facing step 30 near its lower end, below which the lower part 31 of the bore is reduced in cross-section and is internally screwthreaded. The insert tube 18 has a lower part 32 which is of correspondingly-reduced section and is screwthreaded externally, so that the tube 18 can be screwed into the bore 19 from its outer or upper end until a shoulder 33 on the insert tube abuts against the internal step in the bore to provide positive location for the tube 18 in the downward (inward) direction. The inner end face 34 of the insert tube is cut off obliquely to match the obliquity of the surface 14 of the chamber 13 and so as to lie recessed in the bore 19 just clear of the path of the rotor tip seals over the surface 14. Thus the greater part of the thermal expansion of the insert tube 18 will take place outwardly from the shoulder 33, and there will be no danger of the tip portion 32 expanding inwardly into the path of the rotor seals, nor of its becoming loose and entering the chamber 13. The upper end of the insert tube 18 is of concave curved form shaped to match, and form a part of, the internal surface of the part 16A of the primary ignition chamber 16. The tube 18 extends upwardly along the side of the chamber part 16A until it approaches the sealed junction 35 between the plug 21 and the wall of the casing 15, there being a clearance between the upper end of the tube 18 and the plug 21. A dowel 36 prevents rotation of the tube 18 about its axis.

The bore 17 of the insert tube 18 may be of circular section or of kidney-section, as required, and its axis 37 is nearly parallel to the axis 22 of the injector 21 and is nearly tangential to the side of the lower chamber part 16A. The tube 18 is made of highly-refractory material of good thermal capacity, and its throat may if necessary be lined with a material of superior heat resistance to avoid burning. Water cooling passages 38 are provided in the housing wall to cool the lower part 16A of the primary chamber 16 and the insert tube 18, and the upper part 16B of the primary chamber 16 is cooled by the recess passages 20 around the plug 21. The through-bolts of the housing 15 are shown at 39.

If desired the plane of the junction 35 between the plug 21 and the housing wall could be at right angles to the axis of the insert tube 18 to facilitate assembly.

FIG. 2 shows a modified arrangement, in which the lower part 16A of the primary ignition chamber 16 has a flat bottom wall 40 into which the bore 19 breaks, the upper end of the insert tube 18 being partially cut off obliquely at 41 to lie flush with the bottom wall 40. In this case the insert tube is not screwthreaded, but a portion 42 of its length just below the shoulder 33 is a press fit into a corresponding portion of the bore 19. A dowel 43 extends into the shoulder 33 of the tube 18 to prevent its rotation about its axis. In other respects the arrangement of FIG. 2 is similar to that of FIG. 1.

In each of these illustrated arrangements, up to approximately 50% of the clearance volume of each combustion space in the engine is afforded by the primary ignition chamber.

What is claimed is:

1. A rotary piston compression-ignition internal combustion engine comprising a housing defining a main chamber comprising n lobes and a subsidiary chamber, the lower part of which is formed by a shaped recess, which serves as a primary ignition chamber and which communicates with the main chamber via a bore in the housing wall leading from the recess to the chamber, a shaft extending axially of the housing, an $(n+1)$ sided piston eccentrically mounted on the shaft and rotatable in the housing, a seal mounted at each apex formed between each pair of adjacent sides of the piston, means for injecting fuel into the primary ignition chamber, a tubular insert of a refractory material fitted into the bore and stopping short of the internal surface of the main chamber and means positively locating the insert in the bore for preventing the insert from expanding into the main chamber during operation of the engine.

2. A rotary piston compression-ignition internal combustion engine as claimed in claim 1, in which anchoring means are provided for anchoring the tube in the bore.

3. A rotary piston compression-ignition internal combustion engine as claimed in claim 1, in which the tubular insert is externally screwthreaded and is screwed into a complementary screwthreaded portion of the bore in the housing to provide the positive location means.

4. A rotary piston compression-ignition internal combustion engine as claimed in claim 1, in which a dowel is provided to secure the tubular insert against rotation in the bore.

5. A rotary piston compression-ignition internal combustion engine as claimed in claim 1, in which the bore in the housing breaks through at an oblique angle to the internal surface of the main chamber and the inner end face of the insert tube is correspondingly oblique.

6. A rotary piston compression-ignition internal combustion engine as claimed in claim 1, in which the lower part of the primary ignition chamber, which is formed in the housing, is of rounded concave form, and the upper end face of the insert tube is correspondingly-rounded to form a part of the internal surface of the primary ignition chamber.

7. A rotary piston compression-ignition internal combustion engine as claimed in claim 1, in which the upper part of the primary ignition chamber is formed in a separate liquid-cooled plug which is inserted into a recess in the wall of the housing and the tubular insert extends upwardly close to the junction between the plug and the housing, a clearance being provided between the insert and the plug.

8. A rotary piston compression-ignition internal combustion engine as claimed in claim 1, in which the lower end of the tubular insert is a press-fit in the lower end of the bore in the housing.

9. A rotary piston compression-ignition internal combustion engine as claimed in claim 1, in which a combustion recess is formed in the circumferential surface of each flank of the rotor for co-operation with the primary ignition chamber.

10. A rotary piston compression-ignition internal combustion engine as claimed in claim 1, in which the means for injecting fuel comprises an injector projecting obliquely and near-tangentially into the upper part of the primary ignition chamber.

11. A rotary piston compression-ignition internal combustion engine as claimed in claim 1, in which the rotor housing wall defines coolant passages.

12. A rotary piston compression-ignition internal combustion engine as claimed in claim 1, in which the lower part of the primary ignition chamber has a flat bottom wall into which the bore for the tubular insert breaks obliquely.

13. A rotary piston compression-ignition internal combustion engine as claimed in claim 12, in which part of the upper end face of the tubular insert is flush with the flat bottom wall of the primary ignition chamber, and another part thereof forms a part of the side wall of the lower part of the primary ignition chamber.

14. A rotary piston compression-ignition internal combustion engine as claimed in claim 1, wherein said positive locating means includes an external abutment surface formed on said tubular insert and an abutment surface is formed in the bore against which the abutment surface of the tube bears such that expansion of the tube takes place mainly in a direction away from the main chamber.

15. A rotary piston compression-ignition internal combustion engine as claimed in claim 14, in which the abutment is a step.

16. A rotary piston compression-ignition internal combustion engine as claimed in claim 14, in which the abutment is a step, and in which those portions of the insert and bore below the step are provided with complementary screwthreads.

* * * * *